United States Patent [19]

Reynolds

[11] Patent Number: 5,028,803

[45] Date of Patent: Jul. 2, 1991

[54] INTEGRATED DRIVE GENERATOR SYSTEM WITH DIRECT MOTOR DRIVE PRIME MOVER STARTING

[75] Inventor: Richard W. Reynolds, Rockford, Ill.

[73] Assignee: Sundstrand Corporation, Rockford, Ill.

[21] Appl. No.: 327,075

[22] Filed: Mar. 22, 1989

[51] Int. Cl.[5] ..... F02N 11/04

[52] U.S. Cl. ..... 290/31; 290/46

[58] Field of Search ..... 290/10, 22, 31, 46

[56] References Cited

U.S. PATENT DOCUMENTS

| | | | |
|---|---|---|---|
| 3,699,351 | 10/1972 | Addie | 290/14 |
| 3,786,696 | 9/1972 | Aleem | 74/687 |
| 4,252,035 | 2/1981 | Cordner et al. | 74/687 |
| 4,315,442 | 2/1980 | Cordner | 74/687 |
| 4,473,752 | 5/1982 | Cronin | 290/38 |
| 4,557,160 | 12/1985 | Reynolds | 74/687 |
| 4,609,842 | 9/1986 | Aleem et al. | 310/112 |
| 4,708,030 | 3/1985 | Cordner | 74/686 |
| 4,734,590 | 3/1988 | Fluegel | 290/1 C |
| 4,743,776 | 5/1988 | Baehler et al. | 290/31 |
| 4,772,802 | 8/1987 | Glennon et al. | 290/31 |

*Primary Examiner*—A. D. Pellinen
*Assistant Examiner*—W. E. Duncanson, Jr.
*Attorney, Agent, or Firm*—David H. Hitt

[57] ABSTRACT

This invention relates to an integrated drive generator of the type employed onboard aircraft for power generation and prime mover starting. Prior art integrated drive generators which provided for a prime mover starting mode drove a prime mover through a constant speed transmission in order to provide motive power to the engine. The present invention provides a power path for prime mover starting which couples the motor/generator directly to the prime mover and decouples the motor/generator from the transmission by means of properly oriented one-way clutches. The integrated drive generator includes in combination in input-/output shaft, and motor/generator having a rotor shaft, a constant speed transmission having an input and an output, a start power path coupling the motor/generator rotor shaft to the input/output shaft whereby the motor/generator, functioning as a motor, drives the input/output shaft as an output shaft, bypassing the transmission, to thereby start the prime mover coupled to the input/output shaft, and a generate power path coupling the input/output shaft to the transmission input and coupling the transmission output to the motor/generator rotor shaft whereby the prime mover drives the motor/generator as a generator at constant speed through the input/output shaft, functioning as an input shaft, and the transmission to produce constant frequency electrical power from the motor/generator for aircraft electrical equipment.

9 Claims, 2 Drawing Sheets

INTEGRATED DRIVE GENERATOR SYSTEM WITH DIRECT MOTOR DRIVE PRIME MOVER STARTING

TECHNICAL FIELD

This invention pertains to an integrated drive generator ("IDG") system for use onboard aircraft wherein a prime mover (e.g. an aircraft engine) is used as a power source for an electrical generating system for the aircraft and wherein the IDG can provide motive power to the aircraft engine via a directly coupled motor/generator within the IDG.

BACKGROUND OF THE INVENTION

In a conventional IDG system, an input shaft connectable to gearbox driven by an aircraft engine is connected to a mechanical differential, the differential having an output connected to drive a generator. A variable speed transmission, such as a hydromechanical transmission, is associated with the mechanical differential and controlled to modify the output of the differential, as required, whereby the input speed to the generator remains constant even though the speed of the input shaft may vary. In conventional IDG systems which provide for engine starting, the generator is replaced by a motor/generator which is driven by a constant frequency source of electrical energy. Mechanical output from the motor/generator is routed through the variable speed transmission and differential to an input/output shaft. In other words, the conventional generating-starting IDG system simply reverses the power path for engine starting.

In the past, IDG's have been modified in many ways to perform under a variety of operating requirements. Following are descriptions of IDG's, all of which have the capacity to start aircraft engines, although methods of doing so may vary greatly.

U.S. Pat. No. 4,315,442 ("'442"), which issued on Feb. 16, 1982 to Cordner, is directed to a hydraulic control system for an aircraft starter/drive mechanism that includes a generator that can be driven as a motor drivingly connected through a differential, which is mutually connected to first and second hydraulic units and to an engine drive shaft during a start mode. The hydraulic control system includes a control valve arrangement, cooperatively coupled to the first and second hydraulic units, and operative in the starting mode to control flow between the hydraulic units, to thereby divide the delivery of rotary power from the motor/-generator to the engine drive shaft through the differential and the hydraulic units. In other words, Cordner '442 provides for a starter/generator system which has different drive ratios for start and generate operation. Further, Cordner uses the hydromechanical drive in the start cycle, running the generator as a motor at its synchronous speed while starting. The invention to be described, on the other hand, is directed to exclusion of the hydromechanical transmission during start mode to avoid deleterious viscous drag and friction.

U.S. Pat. No. 4,708,030 ("'030"), which issued on Nov. 24, 1987 to Cordner, is directed to a starter/generator drive useable in an aircraft which must be of the smallest possible size and the lowest possible weight and have maximum reliability. A drive having a multi-speed transmission and a controllable hydro-viscous dissipative clutch can be interposed between an engine and a starter-generator to achieve maximum efficiency in the drive and meets the forgoing objectives. The starter-generator drive has a multi-speed transmission for stepping the input speed from an engine to a hydro-viscous dissipative clutch to provide plural speed ranges of operation and thus limit the amount of slip that occurs within the clutch in each range to provide the constant speed drive of the generator. The dissipative clutch operates in a hydro-viscous manner whereby sudden changes of speed, as the multi-speed transmission shifts, do not vary the torque transmitted to the generator and therefore the speed of the generator. This avoids transients in the output power frequency of the generator during ratio changing of the multi-speed transmission. The starter-generator drive also provides for dissipative engine start utilizing the generator as an electric motor. In other words, Cordner U.S. Pat. No. 4,708,030 provides for an electro-mechanical transmission which has a slip clutch and brake for the purpose of changing the mode of operation. In the start mode, the starter-generator drives through the differential and the multi-speed transmission. The present invention, on the other hand, is designed to perform an engine start in a direct fashion, without involving an intermediate hydromechanical transmission and the friction introduced by inclusion thereof.

U.S. Pat. No. 4,473,752, which issued on Sept. 25, 1984 to Cronin, is directed to a starter/generator machine for starting turbine type aircraft engines. The machine combines an induction motor with a synchronous samarium cobalt generator. In the machine, a rotor-shaped stator is fixed and positioned inside a squirrel-cage induction rotor which has an array of samarium-cobalt magnets attached on the outer diameter thereof. The compound dual machine operates as a starter by using the induction rotor to accelerate the permanent magnet rotor, and thus the aircraft engine via a drive pinion, up to some low synchronous speed, when AC power is applied to the outside stator to lock in the permanent magnet rotor synchronously with the rotating field created in the stator of the synchronous generator. As the speed of the rotor is then increased, the engine speed is also increased via the drive pinion. In a second embodiment disclosed, a cartridge type induction-motor is used to initially start an aircraft engine. The motor includes a gear reduction and disconnect clutch and drives the engine through a splined pinion which in turn drives an engine connected spline. When the speed of the machine is such that the synchronous operation of an outside permanent magnet rotor commences, the clutch is utilized to disconnect the induction motor cartridge, leaving the rotor to drive the drive spline via internal splines. Cronin is, therefore, directed to the construction of an induction motor/synchronous motor-generator to be used for starting engines. Cronin fails to provide for a constant speed drive in the generate mode and does not bypass the constant speed drive in the start mode. Accordingly, Cronin does not provide for one-way clutches to accomplish the above.

U.S. Pat. No. 3,786,696, which issued on Jan. 22, 1974 to Aleem, is directed to a starter-drive for use between an aircraft engine and a generator to transmit power in either direction between the engine and the generator, for driving the engine from the generator in a starting mode, and for driving the generator in a generating mode, including a generator shaft, an engine shaft, a differential for transmitting power from the engine shaft to the generator shaft, a hydrostatic transmission including one hydraulic unit connected for rotation with the generator shaft and a second hydraulic unit connected for rotation with a controlled gear in the differential, a first one-way clutch connecting the second hydraulic unit to drive the engine shaft exclusively through the hydrostatic transmission during starting, a second one-way clutch connecting the engine shaft to the differential to transmit power from the engine to the generator after the engine has started, and means for varying the displacement of one of the hydraulic units to bring the engine shaft up to speed during the starting mode and to add or subtract speed in the differential during the generating mode. Aleem apparently discloses a hydro-mechanical transmission generator drive which has overrunning clutches which cause it to operate as a hydrostatic transmission in the start mode with the generator running at a constant speed. The present invention is specifically directed to the object of bypassing the hydrostatic transmission during engine starting. Therefore, Aleem and the present invention have different objects.

In summary, the present invention is the first to provide a hydromechanical transmission for a motor/generator drive which, through the use of overrunning clutches, allows a start mode which bypasses the hydromechanical transmission and operates the motor/generator as a variable speed synchronous motor by the use of pulse width modulation supplied by a start inverter.

DISCLOSURE OF INVENTION

It is therefore a primary object of this invention to provide an integrated drive generator having a first means for coupling a motor/generator shaft to an input/output shaft whereby the motor/generator, functioning as a motor, drives the input/output shaft as an output shaft, bypassing a transmission, to thereby start a prime mover coupled to the input/output shaft.

It is further a primary object of this invention to provide a second means for coupling an input/output shaft to a transmission input and coupling a transmission output to a motor/generator rotor shaft whereby the input/output shaft, functioning as an input shaft, drives the motor/generator as a generator through the transmission to produce electrical power from the motor/generator as a started prime mover drives the input/output shaft.

Another object of the invention is to provide an integrated drive generator wherein a motor/generator is coupled to an electrical source/load to thereby provide a source of electrical power to the motor/generator when the motor/generator functions as a motor and do thereby provide a load for electrical power produced by the motor/generator when the motor/generator functions as a generator.

Yet another object the invention is to provide an integrated drive generator wherein an electrical source/load provides AC power to a motor/generator when the motor/generator functions as a motor and accepts constant frequency AC power from the motor/generator when the motor/generator functions as a generator.

Still another object in the invention is to provide an integrated drive generator wherein a transmission is a constant speed drive comprising a differential having an input, an output, a summing input and a controller driving the summing input to thereby convert variable speed rotation provided by an input/output shaft to the differential input to constant speed rotation to provided to a motor/generator rotor shaft from the differential output.

A still further object of the invention is to provide an integrated drive generator wherein a start power path includes a first one-way clutch coupled between a motor/generator rotor shaft and an input/output shaft, oriented to prevent the input/output shaft from directly driving the motor/generator rotor shaft.

A still further object of the invention is to provide a integrated drive generator wherein a generate power path includes a coupling between an input/output shaft and a transmission input and a second one-way clutch coupled between a transmission output and a motor/generator rotor shaft, oriented to prevent the motor/generator rotor shaft from driving the transmission output.

Yet a further object to the invention is to provide a integrated drive generator wherein an input/output shaft is coupled to a prime mover to thereby drive or be driven by the prime mover.

A final object of the invention is to provide a method for electrically starting a prime mover and generating electricity by drawing power from the prime mover once the prime mover has been started, which method is accomplished by doing the following: coupling a motor/generator to a nonstarted prime mover; electrically driving the motor/generator as a motor to accelerate the nonstarted prime mover; decoupling the motor/generator when the nonstarted prime mover has started; coupling the prime mover to a constant speed drive; coupling the constant speed drive to the motor/generator; and mechanically driving the motor/generator as a generator with the started prime mover through the constant speed drive to produce constant frequency electricity.

In the attainment of the forgoing objects, the integrated drive generator that encompasses the preferred embodiment of the invention includes an input/output shaft, a motor/generator having a rotor shaft and a constant speed drive transmission having an input and an output. A start power path has a first one-way clutch coupled between the motor/generator rotor shaft and the input/output shaft is oriented to prevent the input/output shaft from directly driving the motor/generator rotor shaft. A generate power path comprises a connection between the input/output shaft and the transmission input and a second one-way clutch coupled between the transmission output and the motor/generator rotor shaft. The second one-way clutch is oriented to prevent the motor/generator rotor shaft from driving the transmission output.

The input/output shaft is coupled to a prime mover to thereby drive or be driven by the prime mover. The motor/generator is coupled to an electrical source/load to thereby provide a source of electrical power to the motor/generator when the motor/generator functions as a motor and to thereby provide a load for electrical power produced by the motor/generator when the motor/generator functions as a generator. The source/load provides AC power to the motor/generator when the motor/generator functions as a motor and accepts constant frequency AC power from the motor/generator when the motor/generator functions as a generator. The constant speed drive transmission comprises a differential having an input, an output, and a summing input and a controller driving the summing input to thereby convert variable speed rotation provided by the input/output shaft to the differential input to constant speed rotation to be provided to the motor/generator rotor shaft from the differential output.

The integrated drive generator is encased in a sealed enclosure suitable for use in an engine compartment on board an aircraft.

Other objects and advantages of the present invention will be apparent upon reference to the accompanying description when taken in conjunction with the following drawings:

BEST MODE FOR CARRYING OUT INVENTION

Figure 1:
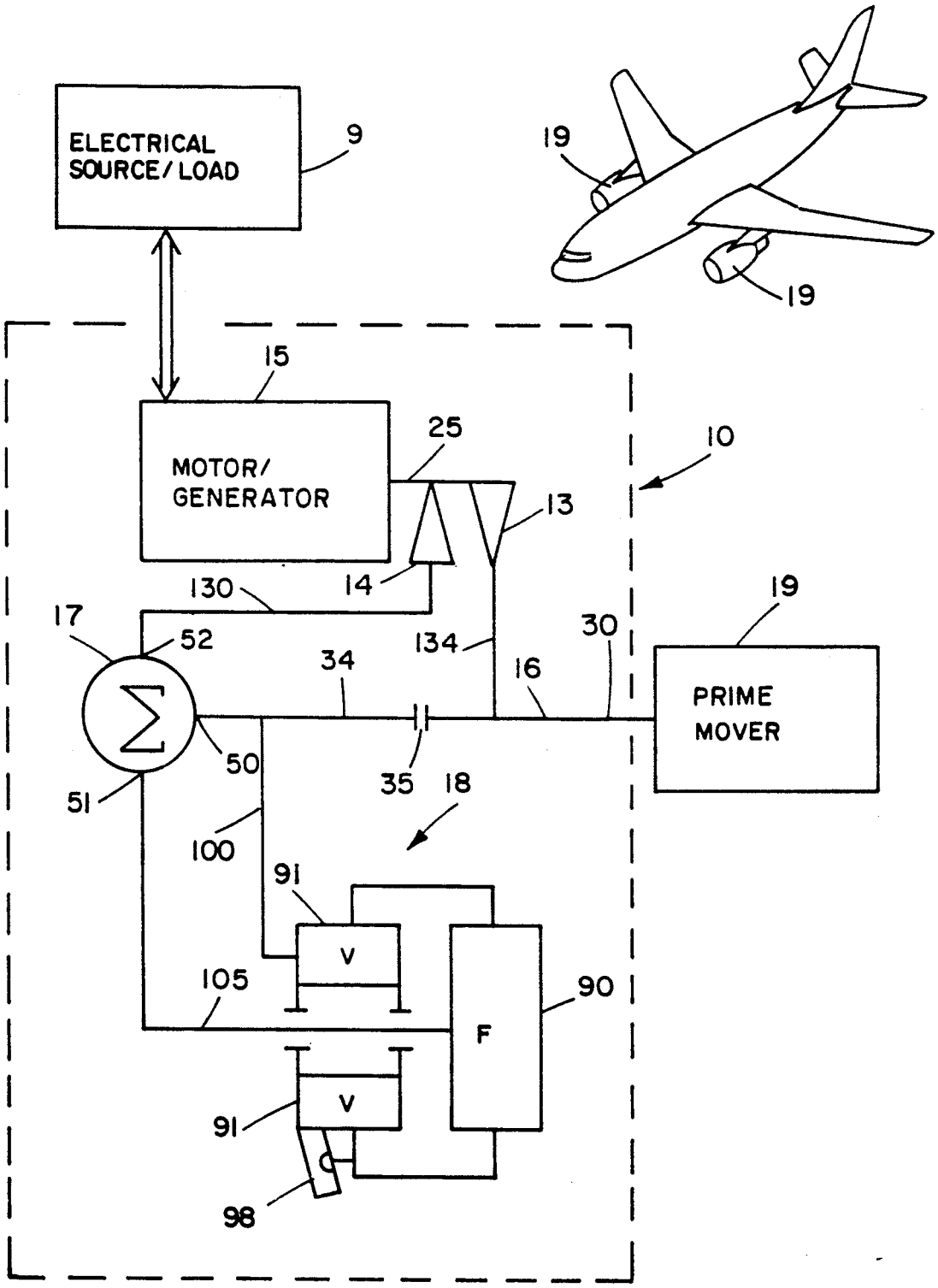
FIG. 1 in schematic form illustrates the integrated drive generator incorporating the present invention.

FIG. 1 schematically shows an integrated drive generator ("IDG") system indicated generally as 10 embodying the present invention. A conventional IDG comprises an input/output shaft 16, a differential 17, a hydromechanical transmission 18, and a motor/generator The input/output shaft 16 is joined to a shaft 34 by a quick disconnect mechanism 35. Shaft 34 will be referenced hereinafter, from time to time, as a variable speed shaft 34, because it is understood that rotation of shaft 34 is a function of variable speed prime mover 19. The connecting shaft 30 is joined to the input/output shaft 16 and a prime mover 19. The hydromechanical transmission 18 comprises one or more fixed displacement hydraulic pump/motors 90 hydraulically coupled to one or more variable displacement hydraulic pump/motors 91. The "pump/motors" will hereinafter be referred to as "units". The variable displacement hydraulic units 91 are varied in their displacement by controllable swash plates 98 which vary the stroke of the pistons within the variable displacement hydraulic units 91. A motor/generator 15 has a rotor (not shown in FIG. 1) within to which is affixed a rotor shaft 25. The present invention contemplates the addition of two one-way clutches: a first one-way clutch 13 on rotor shaft 25 and a second one-way clutch 14 on a constant speed shaft 130 coupled between the differential 17 and the motor/-generator rotor shaft 25.

The IDG 10 is configured to provide motive energy to the prime mover 19 in order to start the prime mover 19 and to accept motive energy from the prime mover 19 to produce electricity for use onboard an aircraft.

In order to start the prime mover 19, electricity is supplied from an external source/load 9 to the motor/-generator 15. Accordingly, the motor/generator 15 operates as a motor to drive the motor/generator rotor shaft 25. The motor/generator rotor shaft 25 drives through the first one-way clutch 13 via start shaft 134 to the input/output shaft 16, now functioning as an output shaft. The input/output shaft 16 drives through the connecting shaft 30 to accelerate the prime mover 19. Note that the second one-way clutch 14 prevents motive energy produced by the motor/generator rotor shaft 25 from driving the differential 17.

Under normal conditions, the prime mover 19 will be accelerated until it starts. When the prime mover 19 starts, the prime mover 19 will then begin to supply motive power back through the connecting shaft 30 into the integrated drive generator 10. Motive energy supplied by the connecting shaft 30 is routed through the input/output shaft 16 and then into the quick disconnect 35 and the variable speed shaft 34 the input/output shaft 16 now functioning as an input shaft. The variable speed shaft 16 drives an input 50 on the differential 17 and the variable displacement hydraulic units 91 via a tubular quill shaft 100. The swash plates 98 are controlled to vary the displacement of the variable displacement hydraulic units 91 by conventional means not shown. Accordingly, since the fixed displacement hydraulic units 90 are hydraulically coupled to the variable displacement hydraulic units 91, the rotational speed of the output of the fixed displacement hydraulic units 90 vary as a function of the position of the swash plates 98. Accordingly, the fixed displacement hydraulic units deliver a varying output to an input 51 of the differential 17 via shaft 105.

The theory of operation of a constant speed drive is that if an input 50 from the input/output shaft 16 varies and an input 51 from the fixed displacement hydraulic units 90 vary, one of the two variations can be controlled so that the combined variations offset one another, producing a constant speed output 52. In the present invention, the constant speed output 52 is produced by the differential 17 and transferred through the constant speed shaft 130 and the second one-way clutch 14 to the motor/generator rotor shaft 25. Accordingly, electrical output supplied to the external source/load 9 is of a constant frequency. Constant frequency output is an important requirement onboard aircraft, where sensitive electrical systems require high quality electric power in order to operate. Therefore, it is of paramount importance that the output of the motor/generator 15 be of constant frequency. The industry-standard aircraft power frequency is three phase, 400 Hz AC power. It should be noted that when the motor/generator 15 is driven as a generator by the prime mover 19, the first one-way clutch 13 prevents the input/output shaft 16 from directly driving the motor/generator rotor shaft 25.

The described structure has several distinct advantages. First, advances in three phase PWM inverter technology permit the motor/generator 15 to be driven as a variable speed synchronous motor by a three phase AC inverter (a part of the electrical source/load 9) which supplies pulse width modulated ("PWM") AC waveforms to the motor/generator 15 at an ever increasing frequency to accelerate the prime mover 19 from any initial speed to any greater final speed to start the same. For instance, if the prime mover 19 were at a standstill, the inverter (not shown) would supply PWM power to the motor/generator 15 at a very low AC frequency. This initial very low AC frequency would be sufficient to begin to turn the rotor of the motor/generator 15 at a very low rate of speed in synchronization with the AC frequency. As the speed of the motor/generator 15 rotor and, accordingly, the speed of the prime mover 19 begins to increase, the PWM patterns produced by the inverter (not shown) would increase in frequency to continue to drive the motor/generator 15 rotor at ever-increasing speeds. In effect, the motor/-generator 15 rotor would "chase" a magnetic field of ever-increasing rotational velocity created by the motor/generator 15 stator, the motor/generator 15 always being driven in a synchronous fashion.

The second advantage of the present invention is that the differential 17 and the hydromechanical transmission 18 need not be driven by the motor/generator 15 while it is attempting to accelerate the prime mover 19.

The differential 17 and the hydromechanical transmission 18 exert considerable drag. Inclusion of the hydromechanical transmission 18 in a start power path is especially deleterious to system efficiency because of the numerous hydraulic links present which, by their very nature, result in viscous drag. By eliminating the differential 17 and the hydromechanical transmission 18 from the start power path, considerable efficiency of power transfer from the motor/generator 15 to the prime mover 19 can be realized. Accordingly, this increase in efficiency can be realized in lower strain on the motor/generator 15, perhaps resulting in a lower motor power rating requirement for the motor/generator 15 and lower power output requirements for the PWM inverter (part of the electrical source/load 9). All of these changes can result in a lighter weight IDG, an important advantage for aircraft systems. Alternatively, increases in efficiency by use of the present system can result in more power being transferred to the prime mover 19 during start, resulting in quicker starts due to more rapid acceleration.

Figure 2:
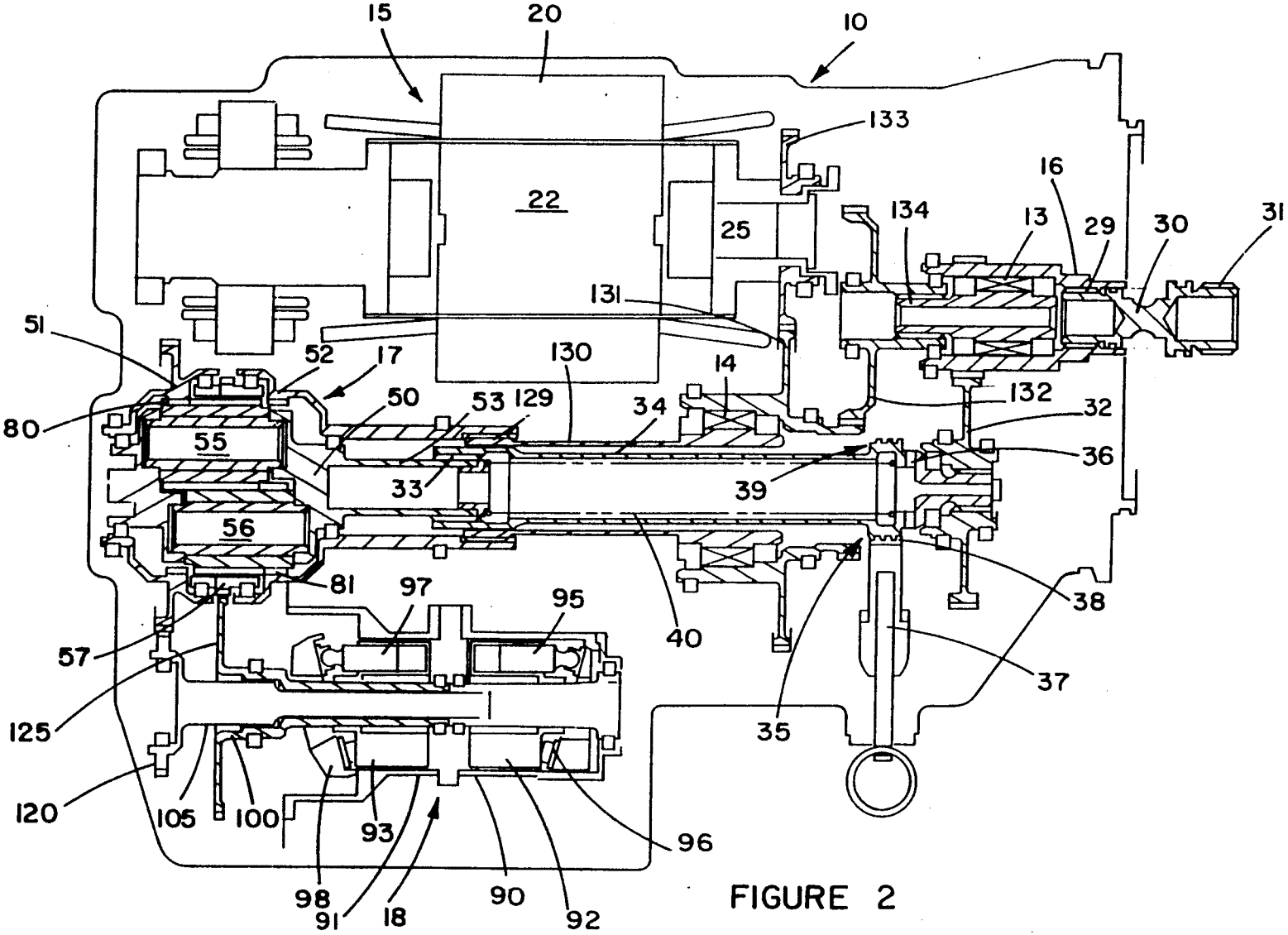
FIG. 2 is a full section view of an integrated drive generator embodying the present invention.

Referring now FIG. 2, which shows, in full section, the IDG 10 embodying the present invention and, accordingly, shows in greater detail the position and relation of parts therein, operation of the IDG 10 including the improvements of the present invention will now be explained.

Components of the IDG 10 include the electrical motor/generator, indicated generally at 15, which is to be operated at a constant speed by means of the prime mover (not shown in FIG. 2 but shown in FIG. 1 as 19) coupled to the input/output shaft 16 via a splined connecting shaft 30. The prime mover does not directly drive the motor/generator 15, since the speed of the input/output shaft 16 may vary, depending upon the speed of the prime mover.

The system includes a mechanical differential, indicated generally at 17, and a variable speed transmission, indicated generally at 18, which is preferably in the form of a hydromechanical transmission although the variable speed transmission 18 may take the form of a controllable electric motor.

The generator 15 has a stator 20 associated with a rotor 22 and which has electrical windings associated therewith. The rotor 22 is mounted on a rotor shaft 25 which is supported at opposite ends by a pair of bearings (shown, but not referenced). The rotor shaft 25 is mounted for rotation relative to the stator 20.

The input/output shaft 16 is coupled by a spline 29 to a connecting shaft 30 having a splined section 31 located externally of the IDG 10 for connection to an output drive from the prime mover (not shown). Rotation of the input/output shaft 16 is imparted to a variable speed shaft 16 through a gear 32 and a quick-disconnect structure, indicated generally at 35 and which is of a type known in the art and shown in a patent to Gantzer, U.S. Pat. No. 3,365,981, the disclosure thereof incorporated herein by reference.

Generally, the quick-disconnect structure includes a disconnectable clutch 36 between the gear 32 and the variable speed shaft 34 and a quick-disconnect operator 37 which may be moved from the position shown toward the axis of the drive input shaft to cause engagement between gear teeth 38 and 39 and which causes movement of the variable speed shaft 34 toward the left against the action of a spring 40 to release clutch 36 which stops the drive of the variable speed shaft 34.

The mechanical differential 17 has a mechanical carrier 50 and a pair of annular spaced-apart ring gears 51 and 52. The carrier 50 has a tubular end 53 coupled by an internal spline 33 with an end of the variable speed shaft 34 permitting axial movement of the variable speed shaft 34 while maintaining a drive relation thereof to the carrier 50. The carrier 50 rotatably mounts a pair of inner meshing pinion gears 55 and 56 which are associated with each of the ring gears 51 and 52, respectively. Additionally, the carrier has a series of external gear teeth 57 positioned in the space between the ring gears 51 and 52. The components of the mechanical differential 17 are supported relative to the housing (shown, but not referenced) and each other by a series of bearings (shown, but not referenced). The pinion gear 55 meshes with internal gear teeth 80 on the ring gear 51 and the mesh between ring gear 52 and pinion gear 56 is by internal teeth 81 on the ring gear 52.

The variable speed transmission 18 shown is a hydromechanical transmission having hydraulically-coupled coaxial units. These units are axial piston units; one is of a fixed displacement 90 while the other is of variable displacement 91 (only one is shown, although it is understood that more may be used). Each of the units is of the same basic structure, including rotatable cylinders 92 and 93, respectively, in which pistons reciprocate under the control of swash plates 96 and 98.

The fixed displacement unit 90 has pistons 95 under the control of the swash plate 96 which is at a fixed angle while the variable displacement pump 91 has pistons 97 which stroke is controlled by the swash plate 98 which is mounted to have its angle varied by control structure (not shown) but which is well known in the art. The cylinder 93 of the variable displacement unit 91 is driven through an element of the mechanical differential 17 which is connected via a gear 125 to a tubular quill shaft 100 splined to the cylinder 93. The fixed displacement unit 90 drives an element of the differential 17 through a shaft 105 which is splined to the cylinder 92 of the fixed displacement unit 90 and which extends through the tubular quill shaft 100 to couple to the mechanical differential 17 via a gear 120.

The mechanical differential has two drive input connections and two drive output connections. The first drive input connection is that of carrier 50 via the variable speed shaft 34. The second drive input connection is from the fixed displacement unit 90 of the hydromechanical transmission 18 via the gear 120. The first drive output connection from the mechanical differential 17 is from the external gear teeth 57 on the carrier 50 which mesh with the gear 125 on the tubular quill shaft 100 to provide a direct input from the variable speed shaft 34 to the variable displacement hydraulic unit 91. The second drive connection is from the ring gear 52 which is splined to a constant speed shaft 130 by an internal spline 129. Constant speed shaft 130 is connected to a second one-way clutch 14 which is, itself, connected to a gear member 131. Gear member 131 meshes with a gear 133 splined to the rotor shaft 25 of the motor/generator 15.

With the disclosed structure, the speed of the constant speed shaft 130 can be monitored and, as necessary, the displacement of the variable displacement unit 91 varied whereby there is a constant speed of rotation of the ring gear 52 to provide a constant speed drive of the motor/generator rotor 22. The structure for monitoring the output speed and controlling the hydromechanical transmission 18 is well known in the art and does not form a part of the present invention.

The present invention permits the integrated drive generator 10 to function as a prime mover starting mechanism. Prime mover starting is accomplished by driving the motor/generator 15 as a motor, causing rotor shaft 25 to turn. Rotation of rotor shaft 25 causes rotation of gears 133 and 131. Rotation of gear 131 causes rotation of a gear 132 which meshes with a start shaft 134. Start shaft 134 is coupled to a first one-way clutch 13 which is, itself, connected to the input/output shaft 16. Input/output shaft 16 is splined to connecting shaft 30 having the splined section 31 which can deliver torque to a prime mover (not shown in FIG. 2, but shown in FIG. 1 as 19) in order to start it. During the start mode, the second one-way clutch 14 disallows gear 131 from driving constant speed shaft 130. Hence, the differential 17 and the hydromechanical transmission 18 are no longer within the start power path of the IDG 10. This results in significant improvements in efficiency due to the absence of viscous drag and friction inherent in any hydromechanical system.

Direct driving of the motor/generator 15 as a motor can be accomplished by application of constant frequency AC power. However, in the preferred embodiment, an inverter (not shown, but shown in FIG. 1 as part of the electrical source/load 9) is used to supply PWM AC power of varying frequency to the motor/-generator 15. In this manner, the frequency of the power supplied to the motor/generator 15 can correspond to its speed. This correspondence results in motor/generator 15 being driven synchronously at its greatest efficiency. Apparatus for and methods of driving a motor/generator as a motor by supplying PWM variable frequency AC power from an inverter are disclosed in U.S. Pat. No. 4,772,802, which issued on Sept. 20, 1988 to Glennon, et al., assigned to the assignee of the present invention and is incorporated herein by reference.

A typical operating scenario for the integrated drive generator 10 as contemplated in this invention is as follows. Operation begins with engine starting, accomplished by connecting the electrical source (not shown in FIG. 2, but shown in FIG. 1 as 9) for variable frequency AC power (of three phases in the preferred embodiment) to the motor/generator 15. By virtue of the first one-way clutch 13, the motor/generator 15 is coupled to the prime mover. The motor/generator 15 field is modulated by delivering power to the field at ever-increasing frequencies until the prime mover has accelerated to a predetermined point at which ignition of the prime mover can take place. The prime mover can then be accelerated to a self sustaining speed (idle speed).

Assuming a successful start, the prime mover will begin to transfer torque through the connecting shaft 30. However, the first one-way clutch 13, which has allowed the motor/generator rotor shaft 25 to drive the connecting shaft 30, is oriented to disallow the shaft 30 from driving the motor/generator rotor shaft 25. The second one-way clutch 14 which has, until now, disallowed the gear 131 from driving the constant speed shaft 130, now allows the differential 17, which is now the driving member, to drive the constant speed shaft 30 and thereby drive the gear 131 through the properly oriented second one-way clutch 14. In this way, the motor/generator 15 has been decoupled in the sense that it no longer is directly driven by the connecting shaft 30. The motor/generator 15 instead has been coupled through a second, indirect power path passing through the differential 17 and the hydromechanical transmission 18. Through this second power path, the prime mover can drive, by virtue of the differential 17 and the hydromechanical transmission 18, the motor/-generator 15 as a generator at a constant speed which can provide constant frequency AC power to the electrical load (not shown in FIG. 2, but shown in FIG. 1 as 9). In the preferred embodiment, this constant frequency AC Power is three phase 400 Hz power.

From the foregoing description it is apparent that the invention described provides a novel integrated drive generator which provides for two modes of operation: A starting mode in which a motor/generator, functioning as a motor, can directly drive a prime mover in order to start the prime mover, and a generating mode in which the prime mover, once it has been started, can drive the motor/generator as a generator through an alternate power path comprising a differential and a hydromechanical transmission. By driving through the differential and the hydromechanical transmission, motor/generator speed can be regulated and, hence, held constant and independent of the speed of the prime mover. The present invention has the advantage of not having to drive the differential and the hydromechanical transmission in the starting mode, thereby eliminating unnecessary friction and viscous drag inherent therein.

Although this invention has been illustrated and described in connection with the particular embodiments illustrated, it will be apparent to those skilled in the art and that various changes may be made therein without departing from the spirit of the invention as set forth in the appended claims.

I claim:

1. An integrated drive generator, comprising:

an input/output shaft;

a motor/generator having a rotor shaft;

a transmission having an input and an output;

a first means for coupling said motor/generator rotor shaft to said input/output shaft whereby said motor/generator, functioning a motor, drives said input/output shaft as an output shaft, bypassing said transmission, to thereby start a prime mover coupled to said input/output shaft, said first means comprising a first gear fixed to said rotor shaft, said first gear driving through a connecting gear, said connecting gear engagingly driving through a first one-way clutch, said first one-way clutch oriented to prevent said input/output shaft directly diving said connecting gear; and a second means for coupling said input/output shaft to said transmission input and coupling said transmission output to said motor/generator rotor shaft whereby said input/output shaft, functioning as an input shaft, drives said motor/generator as a generator through said transmission to produce electric power from said motor/generator as said started prime mover drives said input/output shaft, said second means comprising a geared coupling between said input/output shaft and a variable speed shaft coupled to said transmission input and a second one-way clutch coupled between a constant speed shaft coupled to said transmission output and said motor/generator rotor shaft, oriented to prevent said motor/generator rotor shaft from driving said transmission output, said constant speed shaft being coaxial with and radially outward of said variable speed shaft.

2. The integrated drive generator as recited in claim 1 wherein said motor/generator is coupled to an electrical source/load to thereby provide a source of electrical power to said motor/generator when said motor/generator functions as a motor and to thereby provide a load for electrical power produced by said motor/generator when said motor/generator functions as a generator.

3. The integrated drive generator as recited in claim 2 wherein said source/load provides AC power to said motor/generator when said motor/generator functions as a motor and accepts constant frequency AC power from said motor/generator when said motor/generator functions as a generator.

4. The integrated drive generator as recited in claim 3 wherein said transmission is a constant speed drive comprising a differential having an input, an output and a summing unit and a controller driving said summing unit to thereby convert variable speed rotation provided by said input/output shaft to said differential input to constant speed rotation to be provided to said motor/generator rotor shaft from said differential output.

5. An integrated drive generator, comprising:

an input/output shaft;

a motor/generator having a rotor shaft;

a constant speed drive transmission having an input and an output;

a first means for coupling having a first one-way clutch coupled between said motor/generator rotor shaft and said input/output shaft, oriented to prevent said input/output shaft from directly driving said motor/generator rotor shaft, said first means comprising a first gear fixed to said rotor shaft, said first gear engagingly driving through a connecting gear, said connecting gear engagingly driving through a first one-way clutch, said first one-way clutch oriented to prevent said input/output shaft from directly driving said connecting gear; and a second means for coupling comprising a connection between said input/output shaft and said transmission input and a second one-way clutch coupled between said transmission output and said motor/generator rotor shaft oriented to prevent said motor/generator rotor shaft from driving said transmission output, said second means comprising a geared coupling between said input/output shaft and a variable speed shaft coupled to said transmission input and a second one-way clutch coupled between a constant speed shaft coupled to said transmission output and said first gear on said motor/generator rotor shaft, oriented to prevent said motor/generator rotor shaft from driving said transmission output, said constant speed shaft being coaxial with and radially outward of said variable speed shaft.

6. The integrated drive generator as recited in claim 5, wherein said motor/generator is coupled to an electrical source/load to thereby provide a source of electrical power to said motor/generator when said motor/generator functions as a motor and to thereby provide a load for electrical power produced by said motor/generator when said motor/generator functions as a generator.

7. The integrated drive generator as recited in claim 6, wherein said source/load provides AC power to said motor/generator when said motor/generator functions as a motor and accepts constant frequency AC power from said motor/generator when said motor/generator functions as a generator.

8. The integrated drive generator as recited in claim 7, wherein said constant speed drive transmission comprises a differential having an input, an output, a summing unit and a controller driving said summing unit to thereby convert variable speed rotation provided by said input/output shaft to said differential input to constant speed rotation to be provided to said motor/generator rotor shaft from said differential output.

9. The integrated drive generator as recited in claim 8, wherein said input/output shaft is coupled to a prime mover to thereby drive or be driven by said prime mover.

* * * * *